United States Patent [19]

Theilacker

[11] Patent Number: 4,711,171

[45] Date of Patent: Dec. 8, 1987

[54] SYSTEM FOR LATERAL TRANSPORT OF LIQUID ALONG A PRINTING MACHINE ROLLER

[75] Inventor: Klaus Theilacker, Friedberg, Fed. Rep. of Germany

[73] Assignee: M.A.N. Roland Druckmaschinen Aktiengesellschaft, Offenbach am Main, Fed. Rep. of Germany

[21] Appl. No.: 927,736

[22] Filed: Nov. 5, 1986

[30] Foreign Application Priority Data

Nov. 19, 1985 [DE] Fed. Rep. of Germany ..... 3540912

[51] Int. Cl.[4] ..... B41L 23/00; B41L 25/00

[52] U.S. Cl. ..... 101/148; 101/348; 101/DIG. 14

[58] Field of Search ..... 101/148, 207, 208, 209, 101/210, 216, 348, 349, 350, DIG. 14

[56] References Cited

U.S. PATENT DOCUMENTS

| | | | |
|---|---|---|---|
| 3,299,801 | 1/1967 | Bishop | 101/216 UX |
| 3,783,780 | 1/1974 | Saueressig | 101/216 X |
| 4,487,122 | 12/1984 | George et al. | 101/216 X |
| 4,646,638 | 3/1987 | Theilacker | 101/349 |

FOREIGN PATENT DOCUMENTS 3419764 11/1985 Fed. Rep. of Germany .

*Primary Examiner*—Edgar S. Burr
*Assistant Examiner*—Moshe I. Cohen
*Attorney, Agent, or Firm*—Frishauf, Holtz, Goodman & Woodward

[57] ABSTRACT

Liquid is moved axially along a liquid roller (1) by a transport roller (2) from end regions towards the center region by forming the transport roller (2) with two conical surface regions (4, 5) which, alternately, are tipped in engagement with the liquid roller (1) while the respectively engaged conical section (e.g. FIG. 1: 4) is axially moving towards the center region of the liquid roller (1). The transport roller can receive its drive by surface engagement, for example, by a cylindrical center portion (3) with the liquid roller, and internal gearing, and positioning of bearings (19, 20) retaining the end portions of the double-conical transport roller eccentrically with respect to the common center shaft (18) which is rotated through a reduction gearing (23-25-26), and simultaneously controls axially oscillating or reciprocating movement by a cam - cam follower arrangement (16, 17) so that synchronism between tipping of the conical surfaces in engagement with the liquid roller and axial movement thereof is insured.

9 Claims, 4 Drawing Figures

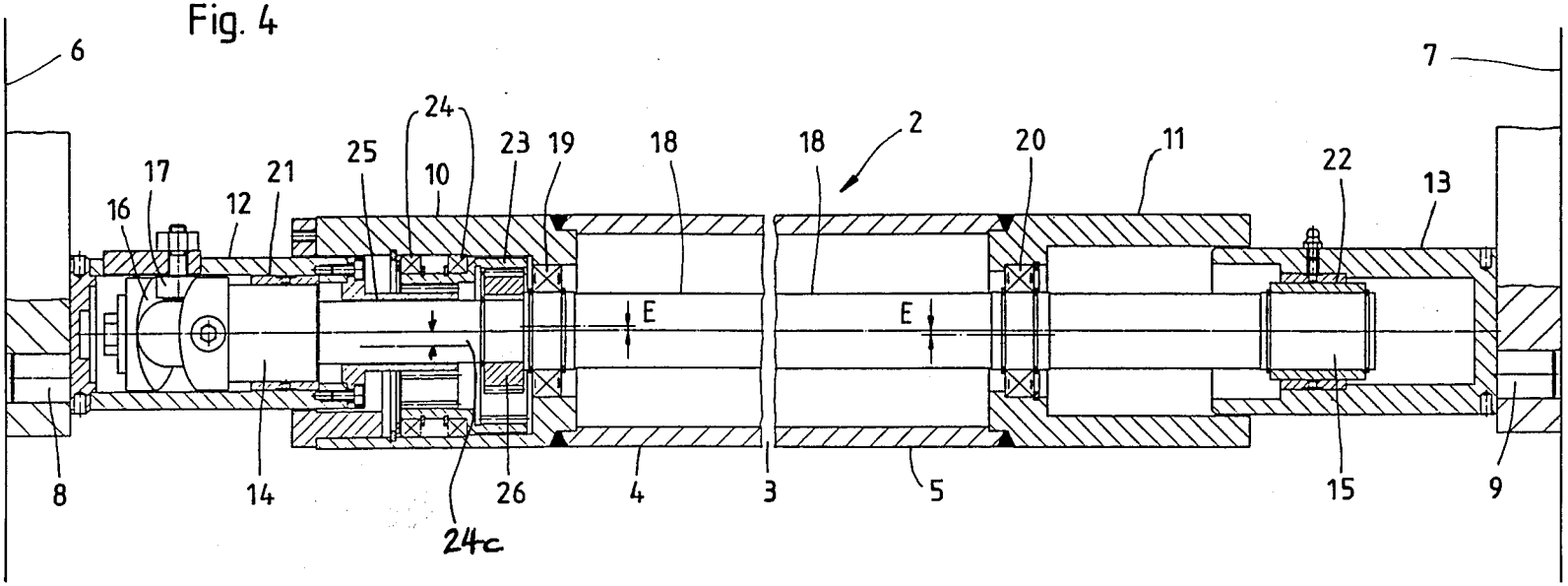
Fig. 4
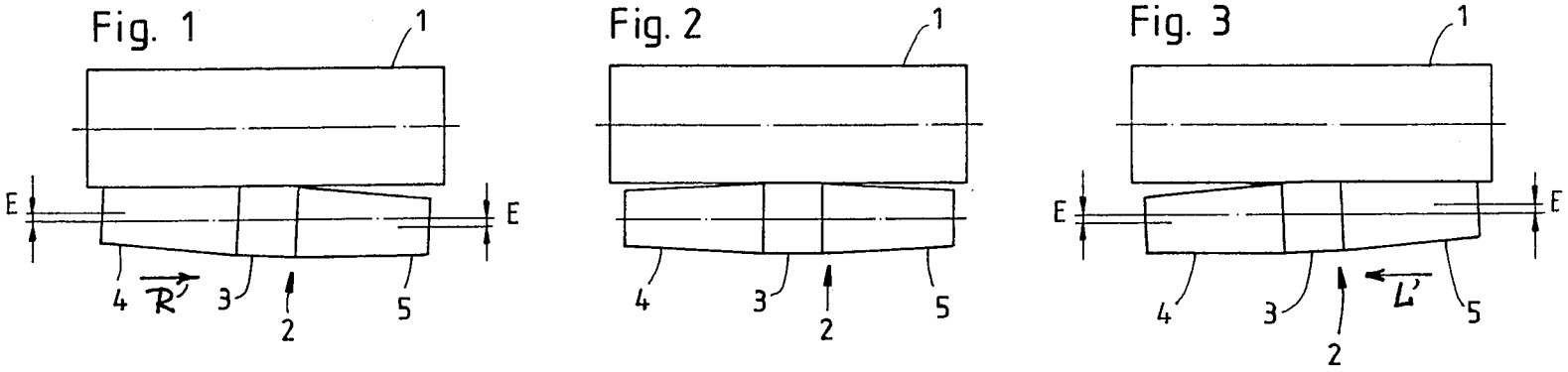
Fig. 3
Fig. 2
Fig. 1

SYSTEM FOR LATERAL TRANSPORT OF LIQUID ALONG A PRINTING MACHINE ROLLER

Reference to related application, assigned to the assignee of the present invention, by the inventor hereof, the disclosure of which is hereby incorporated by reference: U.S. Ser. No. 06/738,663, filed May 28, 1985. (Published and patented German No. 34 19 764).

The present invention relates to a system and apparatus to transport a liquid axially along a rotating roller, and more particularly to such a system and apparatus to transport ink, ink-damping liquid emulsion, and/or damping liquid, typically water, in printing machines. The system is used to move excess liquid from end zones of the respective roller towards the center thereof.

Background

The earlier application by the inventor hereof, U.S. Ser. No. 738,663, filed May 28, 1985, now U.S. Pat. No. 4,646,638, describes a method and device to move liquid axially along a roller and, specifically, a printing machine roller. According to the prior disclosure, the halves of a roller are offset with respect to each other so as to be eccentric, and so arranged that the portion of the roller which is also moving towards the center of the roller is in engagement with a common roller.

The system works well; it has been found, however, that offsetting portions of a roller eccentrically with respect to each other causes difficulty, particularly when the roller is used with printing ink or printing ink-damping liquid (typically water) emulsions, since the ink may collect at the separating surface of the eccentric sections. This is undesirable since, for proper operation, cleaning becomes necessary.

The Invention

It is an object to improve the system in which a liquid is moved axially along a roller from marginal portions to the center portion thereof which is essentially maintenance and service-free, and which is simpler to construct than the prior apparatus.

Briefly, in accordance with the invention, a transport roller is placed in engagement with the surface of the liquid roller, the transport roller having a surface formed by two conical portions which have their smaller diameters adjacent the end portions of the transport roller. The transport roller is oscillated axially, that is, it not only rotates but also reciprocates axially. The respective conical portions of the transport roller are alternately engaged with the liquid carrying roller, the engagement being effected in synchronism with the oscillating or reciprocating movement of the transport roller in such a manner that only that one of the conical portions of the transport roller is engaged with the liquid roller which is then moving with respect to the liquid roller in a direction towards the center of the liquid roller. Thus, the respectively alternately engaged conical surface portions will move liquid on the liquid roller towards the center region of the liquid roller.

DRAWINGS

FIGS. 1, 2 and 3 show, schematically, a liquid roller and engagement thereof with a double-conical transport roller in respectively three different operating conditions; and FIG. 4 shows a longitudinal section through the transport roller, in which the conical surface portion is hardly visible since it is not shown in exaggerated form, as in FIGS. 1–3.

DETAILED DESCRIPTION

Referring first to FIGS. 1 to 3:

A liquid roller 1 has its surface coated with a liquid substance, for example ink, damping fluid such as water, an emulsion of ink and water, or the like. It serves as an application roller of the respective liquid in a rotary printing machine, for example a roller which carries or transfers ink or, in an offset printing machine, a roller which carries or transfers damping liquid, typically water. The liquid roller 1 is in engagement with an axially oscillating or reciprocating transport roller 2, which may be externally driven or merely driven by engagement with the liquid roller to form a rider or idler roller.

In accordance with the invention, the transport or rider roller 2 has two conical surface portions 4, 5, so arranged that the smaller diameter regions thereof are adjacent the outer ends. Preferably, the conical surface portions 4, 5 do not extend to the exact middle of the rider roller 2 but, rather, the rider roller is formed with a cylindrical center portion 3 which remains in continuous engagement with the liquid roller 1, so that the rider roller 2 is continuously driven by frictional engagement with the liquid roller 1. It is, however, also possible to use a separate drive for the oscillating or reciprocating liquid roller 2 and to eliminate the region 3. The cylindrical region 3 need be just wide enough to provide for positive driving engagement between the rollers 1 and 2.

Referring also to FIG. 4, the transport roller 2 is retained in bearings 8, 9, secured to side walls 6, 7 of a printing machine. The bearings 8, 9 preferably include bearing pins which are eccentrically located in suitable bearing bushings. The rider roller 2 has two end regions 10, 11 of enhanced wall thickness; bearing sleeves 12, 13 engage within the tubular end regions 10, 11. Slide bearings 21, 22 are located within the bearing sleeves 12, 13. The slide bearings 21, 22 receive shaft stubs 14, 15 of the shaft 18 of the roller 2. A cam track 16 is secured to one of the stub shafts, as shown to the left stub shaft 14. A stationary, fixed cam follower 17, in form of a roller which is retained by a shaft on the bearing 12, is engaged in the cam 16 to cause axially oscillating movement to occur as the shaft 18 rotates. This arrangement to obtain axial reciprocating movement, by and itself, is well known, and other similar and equivalent arrangements may be used. It is, for example, also possible to control axial movement by a separate drive acting directly on the shaft 18.

In accordance with a feature of the invention, two bearings 19, 20 are located on the shaft 18 which are eccentric, that is, are positioned with an eccentric offset E about the shaft 18; the offset E of the two bearings 19, 20 is, respectively 180° between the two eccenters, as best seen in FIGS. 1, 3 and 4. The tubular end portions 10, 11 are located on the outer races of the respective bearings 19, 20.

The left side of the components of the roller 2 will be described in detail; of course, the specific arrangement could be located at either end, or, with suitable offset, at both ends of the roller 2.

A radially offset bushing 23 is located in the end portion, for example the left end portion 10. The bushing 23 extends at the left over a pair of bearings 24, which are located substantially eccentrically with respect to the jacket or outer circumference of the roller 2. The offset bushing 23 has two sets of gears with different number of gear teeth. The left gear ring is engaged by a sleeve 25 which has external gears formed thereon, matching with internal gears on the bushing 23. The sleeve 25 is coupled with an end flange to the fixed bearing sleeve 12, for example by screws or the like, as shown. The right inner gearing on the bushing or sleeve 23 is engaged by a gear 26 eccentrically located on the shaft 18. FIG. 4 clearly shows that the offset bushing 23 is eccentrically located within the tubular end portion 10 of the roller 2.

Operation

Upon rotation of the liquid roller 1, the transport roller 2 will be carried along by frictional engagement, for example by frictional engagement of the cylindrical portion 3 thereof. Consequently, the interior gear engaged with the inner gearing portion of the sleeve 23, and which has a larger diameter than the inner gearing portion engaged with the gear on sleeve 25, is rotated since the offset sleeve 23 will roll off on the external gearing on the sleeve 25 which is secured to the fixed sleeve 12; sleeve 12, of course, is secured in position on the side wall 6. Consequently, the shaft 18, which is secured to the gear 26, likewise will rotate and, since shaft 26 is coupled to the cam 16, the shaft 26 will move axially, reciprocating or oscillating back-and-forth. This arrangement, simply and effectively, provides for down-gearing between the rotary speed of the jacket 4, 3, 5 of the transport roller 2 and the axial reciprocating motion thereof. A suitable down-gearing is in the order of about 16:1, that is, upon 16 complete revolutions of the jacket 4, 3, 5, shaft 18 will rotate only once, and thus carries out only a single back-and-forth stroke. Of course, other gear ratios may be used and can be provided for by suitable dimensioning and pairing of the respective gears, in accordance with well known gearing design.

In accordance with a feature of the invention, the respective conical portions 4 and 5 of the transport roller are engaged with the liquid roller in synchronism with the rotary position of shaft 18. Thus, upon rotation of the shaft 18, and due to the eccentric offset E of the bearings 19, 20, alternately and in accordance with the respective rotary position of shaft 18, either the left conical portion 4 or the right conical portion 5 will be engaged with the liquid roller 1, and, in accordance with a feature of the invention, so synchronized and so timed that, as the roller 2 moves axially towards the center with respect to the roller 1, the respective conical portion moving towards the center is engaged. Thus, and as seen in FIG. 1, conical portion 4 is engaged when the transport roller 2 is oscillating towards the right, as schematically shown by arrow R; as the reciprocating motion of the roller 2 changes towards the left—see arrow L in FIG. 3—the right-side conical portion 5 will come in engagement with the liquid roller 1. Since the reciprocating, oscillating movement, as well as the tilting or tipping movement of the respective surface portions 4, 5 are both derived from rotation of the shaft 18, precisely timed synchronism between oscillatory or reciprocating movement of the transport roller 2 and the eccentric tipping is always obtained. Any slippage, for example between the cylindrical portion and the roller 1, thus is automatically compensated for. Excess liquid, ink, water, or an ink-water emulsion thus is transported from marginal or end regions of the liquid roller 1 to the center portion thereof. This arrangement effectively prevents flinging or spraying off of liquids from the end portions, or drying of excessive liquids at the end portions, for example drying of accumulated ink.

The offset of the bearing 24 within the end portion 10 is shown in FIG. 4 at 24c.

In one embodiment, the liquid roller 1 has an axial length of about 1 meter; for such a roller, the central cylindrical portion 3 then can have an axial length of about 10 cm. The eccentric offset E at either end is approximately 0.2 mm. Similarly, the end portions of the conical surfaces 4, 5 will then be 0.2 mm less than the center portion. This conical shape, and the eccentricity E, is shown in FIGS. 1–3 highly exaggerated for illustration.

Various changes and modifications may be made within the scope of the invention concept.

I claim:

1. In a printing machine having a liquid roller (1) with a surface adapted to be coated with a liquid, an arrangement to transport excess liquid axially along the liquid roller, comprising, in accordance with the invention, a transport roller (2) in engagement with the surface of the liquid roller (1), said transport roller having a surface formed by two conical portion (4, 5) positioned with the smaller diameters of the conical portions being located adjacent axial end portions of the transport roller;

means (16, 17) for axially oscillating or reciprocating the transport roller (2) with respect to the liquid roller (1);

and means for alternately engaging the respective conical portions of the transport roller with the liquid roller (1) in synchronism with the oscillating or reciprocating movement of the transport roller, by engaging that one (see FIG. 1: 4) of the conical portions of the transport roller with the liquid roller (1) which is moving with respect to the liquid roller in a direction (R) towards the center of the liquid roller to move liquid on the liquid roller from the end or edge regions thereof towards the center region by alternate engagement of the conical portions of the transport roller with the surface of the liquid roller.

2. Combination according to claim 1, further comprising a cylindrical surface portion (3) on the transport roller positioned between the conical portions (4, 5), said cylindrical surface portion being in continuous surface engagement with the liquid roller (1).

3. Combination according to claim 1, further comprising bearings (19, 20) located at respective end portions of the conical roller (2), the bearings at the respective end portions being offset with a predetermined eccentricity (E) on a shaft (18) of the transport roller, said bearings being relatively offset with respect to each other by 180°;

and wherein said means for axially oscillating or reciprocating the transport roller (2) comprises cam and cam follower means (16, 17) coupled, respectively, to said shaft and to a fixed position on said printing machine.

4. Combination according to claim 1, wherein said means for alternately engaging the respective conical portions (4, 5) of the transport roller (2) with the liquid roller (1) in synchronism with oscillating or reciprocating movement of the transport roller comprises an axially and radially offset brushing or sleeve (23) located within a tubular end portion (10) of at least one (4) of the conical portions (4, 5);

two internal gearings of different gear tooth numbers being located within the bushing or sleeve (23), one of the gearings being in engagement with a gear (12) fixed in position and secured to said printing machine and another gear, in engagement with the other inner gearing, being secured to a shaft (18) of the transport roller (2).

5. Combination according to claim 4, wherein the offset bushing or sleeve (23) is positioned in the tubular end portion (10) of the transport roller by an eccentric offset (24c).

6. Combination according to claim 4, further comprising bearings (19, 20) located at respective end portions of the conical roller (2), the bearings at the respective end portions being offset with a predetermined eccentricity (E) on a shaft (18) of the transport roller, said bearings being relatively offset with respect to each other by 180°;

and wherein said means for axially oscillating or reciprocating the transport roller (2) comprises cam and cam follower means (16, 17) coupled, respectively, to said shaft and to a fixed position on said printing machine.

7. Combination according to claim 6, wherein the offset bushing or sleeve (23) is positioned in the tubular end portion (10) of the transport roller by an eccentric offset (24c).

8. Combination according to claim 4, further comprising a cylindrical surface portion (3) on the transport roller positioned between the conical portions (4, 5), said cylindrical surface portion being in continuous surface engagement with the liquid roller (1).

9. Combination according to claim 7, further comprising a cylindrical surface portion (3) on the transport roller positioned between the conical portions (4, 5), said cylindrical surface portion being in continuous surface engagement with the liquid roller (1).

* * * * *